US007198242B1

(12) United States Patent
Bently

(10) Patent No.: US 7,198,242 B1
(45) Date of Patent: Apr. 3, 2007

(54) VENT COVER BRACKET AND PROCESS THEREWITH

(76) Inventor: John F Bently, 11153 S. Wilton River Rd., New Richland, MN (US) 56072

( * ) Notice: Subject to any disclaimer, the term of this patent is extended or adjusted under 35 U.S.C. 154(b) by 0 days.

(21) Appl. No.: 10/755,524

(22) Filed: Jan. 12, 2004

Related U.S. Application Data

(60) Provisional application No. 60/451,445, filed on Mar. 3, 2003.

(51) Int. Cl.
*A47F 5/00* (2006.01)
*A47H 1/10* (2006.01)

(52) U.S. Cl. ..... 248/300

(58) Field of Classification Search ..... 248/300, 248/900, 909, 548, 205.1
See application file for complete search history.

(56) References Cited

U.S. PATENT DOCUMENTS 974,681 A * 11/1910 Manquais ..... 248/300
1,225,525 A * 5/1917 Sweet ..... 220/3.92
2,638,643 A * 5/1953 Olson ..... 428/577
3,128,979 A * 4/1964 Damelio ..... 248/680
4,124,444 A * 11/1978 Jabsen ..... 376/462
4,289,290 A * 9/1981 Miller ..... 248/251
4,870,722 A * 10/1989 Shell, Jr. ..... 24/16 R
5,810,303 A * 9/1998 Bourassa et al. ..... 248/205.1
6,203,232 B1 * 3/2001 Ward ..... 403/14

* cited by examiner

*Primary Examiner*—Amy J. Sterling

(57) ABSTRACT

The invention concerns a bracket, e.g., for securing a vent cover to a vent. The bracket includes a plate having a front face, a back face, a length, a width, and opposing side edges extending in respective length and width directions. The plate includes at least two openings in the plate, each opening wholly contained within the front and back faces so as to not intersect with the side edges. The plate also includes at least one pair of orifices in the plate, the pair of orifices located adjacent opposite side edges of the plate along the length of the plate so as to form a weakened zone widthwise for bending the plate along the weakened zone.

20 Claims, 2 Drawing Sheets

VENT COVER BRACKET AND PROCESS THEREWITH

PRIOR APPLICATION

This application claims the benefit of U.S. Provisional Application No. 60/451445 filed Mar. 3, 2003.

BACKGROUND OF THE INVENTION

Generally, the invention relates to a bracket for assisting in securing members together. More particularly, the invention concerns a new bracket configuration for assisting in securing a vent cover to a wall or ceiling, for example, when the vent cover was originally attached to unsupported drywall of the wall or ceiling.

SUMMARY OF THE INVENTION

The present invention is directed to avoiding at least the just discussed shortcoming. Additionally, the new bracket configuration provided may better enable one to, e.g., more quickly and/or more steadfastly, secure the vent cover in place after removal, especially when the original securing means has worn out. Also, the invention may provide a bracket that is nearly invisible to completely invisible and/or a reusable support for continued reliability use after use. The versatility and simplicity of the new bracket may further advantage it over any prior device. All this can be accomplished, for example, with some or all of the features of the present vent cover bracket and process.

The invention concerns a bracket. The bracket includes a plate having a front face, a back face, a length, a width, and opposing side edges extending in respective length and width directions. The plate also includes at least two openings in the plate, each opening wholly contained within the front and back faces so as to not intersect with the side edges. The plate further includes at least one pair of orifices in the plate, the pair of orifices located adjacent opposite side edges of the plate along the length of the plate so as to form a weakened zone widthwise for bending the plate along the weakened zone.

The invention also concerns a bracket for use with a vent and a vent cover, e.g., to secure the vent cover to the vent. The bracket includes a plate having a front face, a back face, a length, a width, and opposing side edges extending in respective length and width directions. The plate also includes as least two openings in the plate with the openings extending between the front and back faces so as to form the openings completely through the plate. Each opening is wholly contained within the front and back faces so as to not intersect with the side edges. The plate further includes at least one pair of orifices in the plate with the orifices extending between the front and back faces so as to form the orifices completely through the plate. The pair of orifices are located adjacent opposite side edges of the plate along the length of the plate so as to form a weakened zone widthwise for bending the plate along the weakened zone. The at least two orifices intersect the side edges of the plate along the length of the plate and the orifices extend into the plate toward a center axis of the plate relative to the length direction of the plate.

Sill further, the invention concerns a process for using the bracket. The process includes: determining a first opening in the plate for securing the bracket to a vent cover; determining a second opening in the plate for securing the bracket to a vent; and, forming the bracket in accordance with the first determining step and the second determining step. Then, the formed bracket may be secured to the vent and the vent cover, respectively, to maintain the vent cover in proximity to the vent as desired.

Yet further, the invention concerns various configurations of the openings, of the orifices and of the relationships of the openings and the orifices.

These and other features and functions of the present invention will be explained and understood upon reviewing the following detailed description and with reference to the accompanying drawings.

DETAILED DESCRIPTION OF THE INVENTION

Figure 1:
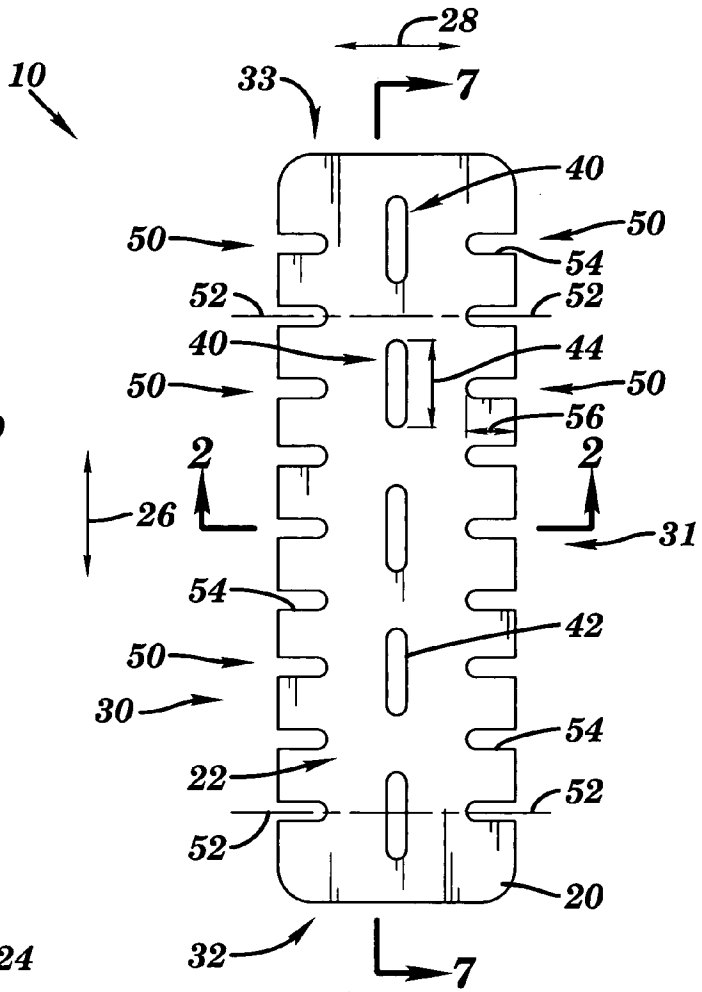
FIG. 1 is a top view of the invention.
Figure 2:
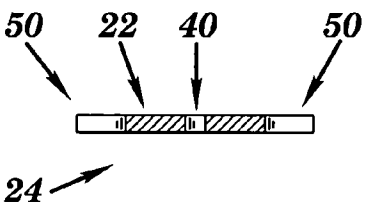
FIG. 2 is a cross-sectional view thereof taken along the line 2—2 in FIG. 1.
Figure 3:
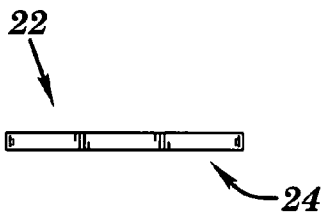
FIG. 3 is an end view thereof, and where the opposite end view is identical thereto.
Figure 4:
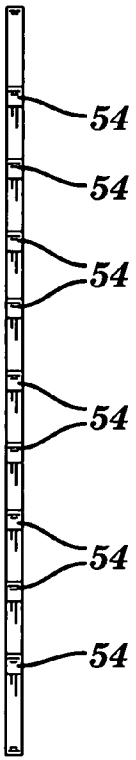
FIG. 4 is a left side view thereof, and where the right side view is identical thereto.

Referring to the FIGS. 1 to 4, for example, there is seen bracket 10. Bracket 10 includes a plate 20 having a front face 22, a back face 24, a length 26, a width 28, and opposing side edges 30/31 and 32/33, each extending in respective length 26 direction and width 28 direction. Plate 20 includes at least two openings 40 in the plate. Each opening is wholly contained within the front and back faces 22 and 24, so as to not intersect with the side edges 30/31 and 32/33. Advantageously, openings 40 may also extend between the front and back faces so as to form the openings 40 completely through the plate, i.e., as opposed to just being surface markings or indentations or scored openings or other openings extending only partially between the front and back faces. Plate 20 also includes at least one pair of orifices 50 in the plate. Advantageously, orifices 50 may also extend between the front and back faces so as to form the orifices 50 completely through the plate, i.e., as opposed to just being surface markings or indentations or scored orifices or other orifices extending only partially between the front and back faces. The pair of orifices 50 are located adjacent opposite side edges 30/31 of the plate along the length 26 of the plate so as to form a weakened zone 52 widthwise for bending the plate along the weakened zone. Advantageously, weakened zone 52 may also be oriented perpendicular to length direction 26 of the plate.

Figure 6:
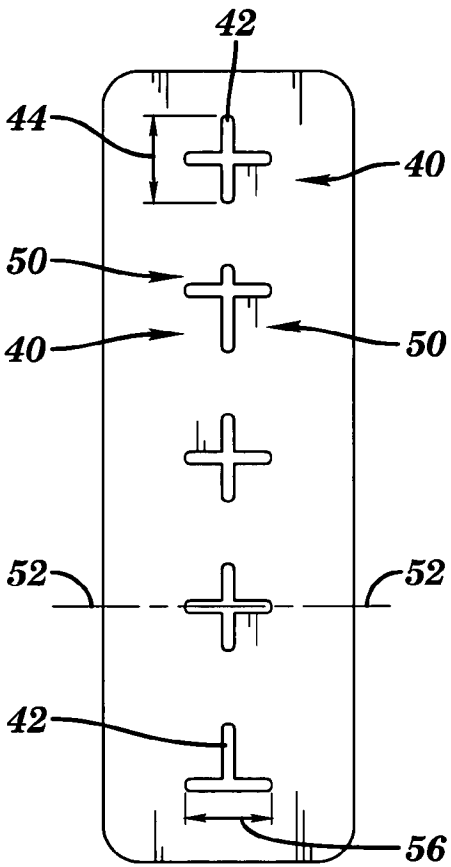
FIG. 6 is a top view of other alternative aspects of my invention.
Figure 5:
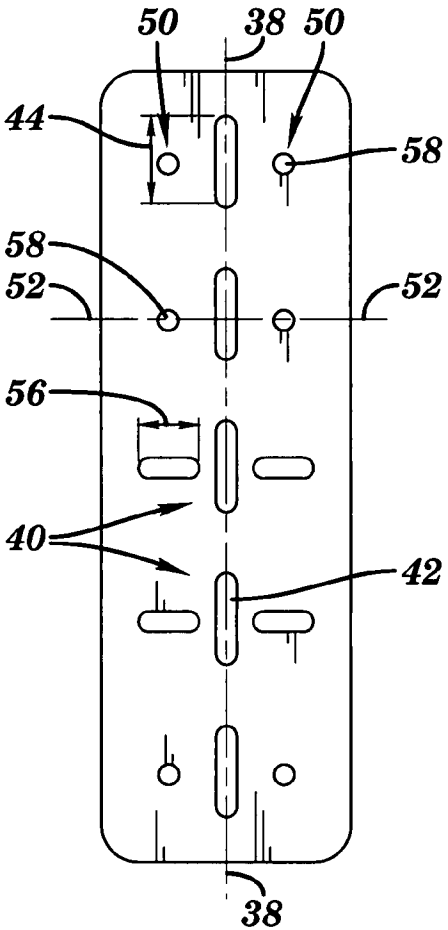
FIG. 5 is a top view of alternative aspects of my invention.

The invention may also include a variety of other features. For example, the at least two openings may be slots 42 or holes (not shown, but like holes 58). The slots 42 are advantageous in adding versatility to the locating process when using the plate, as discussed further below, but holes will clearly work also. Further in this regard, the slots may have a length 44 extending from non-parallel (not shown) to parallel (e.g., generally as seen in FIGS. 1, 5 and 6) to the length direction 26 of the plate. Still further, the slots may be each located off-center (not shown) to along (e.g., generally, as seen in FIGS. 1, 5 and 6) a center axis 38 of the plate relative to the length direction of the plate.

Other features the invention may also relate to the orifices 50. The at least two orifices 50 may be notches 54 (e.g., seen in FIGS. 1, 5 and 6) or holes 58 (e.g., seen in FIG. 5). Here again, notches (which are similar to slots) are advantageous in adding versatility to the process when using the plate in terms of more easily creating a distinct weakened zone 52, as discussed further below, but holes will clearly work also. Further in this regard, the notches 54 may intersect side edges 30/31 of the plate along length 26 and the notches 54 may extend into plate 20 toward center axis 38 of the plate relative to the length direction of the plate (e.g., seen FIG. 1); alternatively, or in combination, notches 54 or holes 58 may not intersect the adjacent opposite side edges 30/31 of the plate along the length of the plate and may not intersect at least one of the at least two openings (e.g., seen in FIGS. 5 and 6). The notches 54 may intersect with at least one of the at least two openings 40 (e.g., seen in FIG. 6). The notches 54 may have a length 56 extending parallel to the width direction of the plate (e.g., seen FIGS. 1, 5 and 6).

Still other features the invention may also concern the relationship of the openings 40 and orifices 50. The various relationships chosen allow a user to balance the need for pre-selected weakened zones formed by the orifices with the versatility provided by the preselected slots when securing the bracket to the vent and then securing the vent cover to the bracket. For example, in this regard, the at least two orifices may be located on opposite sides of at least one of the two openings and midway between opposite ends of the openings (e.g., the bottom-most or top-most notches and the respective opening therebetween, as seen in FIG. 1). As another example in this regard, and more particularly, the at least two orifices may be at least four orifices and one pair of orifices 50 may be located on opposite sides of one of the at least two openings 40 and midway between opposite ends of the one opening and a second pair of orifices may be located on opposite sides of a different opening of the at least two openings and midway between a first end of the one opening and a second end of the different opening, (e.g., the bottom-most or top-most notches and the respective opening therebetween and then also the adjacent pair notches, as seen in FIG. 1).

Figure 7:
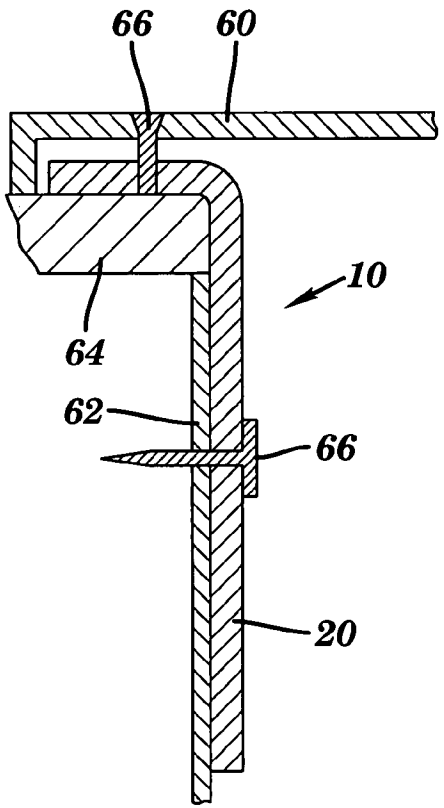
FIG. 7 is a cross-section view of the bracket of FIG. 1 installed in a vent to secure a vent cover in place, and generally taken along the line 7—7 of FIG. 1.

With reference to FIG. 7, yet other features of the invention concern a process for using bracket 10. The process may include determining a first opening in the plate 20 for securing the bracket to a vent cover 60. The process may also include determining a second opening in the plate for securing the bracket to a vent 62. Vent 62 may be located adjacent drywall 64, which could have been the reason for failure of the vent cover connection system in the first place. Once the openings for securing the bracket to the vent cover and the vent are determined, then one may form the bracket in accordance with these determinations. For example, if the bracket is plastic, it is likely molded plastic, and as such would likely be preformed and in an average shape to fit the average situation, or customized for more unique situations as they may exist. Alternatively, if the bracket is metal, it can likely be provided flat (e.g., as seen in the FIGS. 1 to 6) and then bent into its desired shape (e.g., as seen in the FIG. 7). Once the bracket is in its desired shape, it may then be secured to vent cover at the first opening and secured to the vent at the second opening. Advantageously, the securing may be done so the bracket is secured to the vent at the second opening before the bracket is secured to the vent cover at the first opening. The bracket may be secured to the vent and/or the vent cover using any mechanical securing member 66 such as nails, screws, adhesives, or others that achieve the same end as would be known to those of skill in the art.

While it is generally most practical that plate 20 would have the same type of openings and/or orifices, these could be mixed and matched as desired, in combination with the teachings herein, to practice the invention. The plate may be made of various materials. Such materials may have a semi-rigid to rigid characteristic so as to be able to endure the stresses the bracket will be subjected to during its intended lifetime. For example, these may be metals, plastics and substitutes therefore as would be known to those of skill in the art, and such things as steel, galvanized steel and molded plastics may be employed. The plate 10 may be formed by conventional techniques such as stamping, molding, or other forming means. The plate 10 and its variety of features may be made to various sizes as long as the relative relationships between certain components, as discussed above, are maintained as desired. Otherwise, generally, the size of the vent for which the plate is intended and the desired attributes of the plate, will dictate what the overall size of the plate, openings and orifices should be, as would be known to one of ordinary skill in the art in combination with the teachings herein. For example, dimensions such as a length 26 of about 3¼ inches, a width 28 of about 1 inch, openings 50 of about ⅜ inch by 1/16 inch, orifices of about 3/16 inch by 1/16 inch, and all these configured like seen in FIG. 1 with a plate thickness from the front face to the back face of about 1/64 of an inch, may be used for average size vents and vent covers, but other dimensions would work as well.

While the invention has been described in connection with various features and advantages, such is not intended to limit the scope of the invention to the particular form set forth, but, on the contrary, the invention is intended to cover such alternatives, modifications and equivalents as may be defined by the scope of the following claims.

What is claimed is:

1. A bracket comprising:

a rectangular plate having a front face, a back face, a length and a width where the length is greater than the width, and opposing side edges extending in respective length and width directions with the length direction being longer than the width direction;

at least two openings in the plate, each opening wholly contained within the front and back faces so as to not intersect with the side edges and wherein the at least two openings consisting of only a single row of slots and the slots have a length and a width where the length is greater than the width and with the length extending parallel to the length direction of the plate and the slots are each located on or along a center axis of the plate relative to the length direction of the plate; and, at least one pair of orifices in the plate, the pair of orifices located adjacent opposite side edges of the plate along the length of the plate so as to form a weakened zone widthwise for bending the plate along the weakened zone.

2. The bracket of claim 1 wherein the openings extend between the front and back faces so as to form the openings completely through the plate.

3. The bracket of claim 1 wherein the orifices extend between the front and back faces so as to form the orifices completely through the plate.

4. The bracket of claim 1 wherein the weakened zone is oriented perpendicular to the length direction of the plate.

5. The bracket of claim 1 wherein the at least two orifices comprise notches or holes.

6. The bracket of claim 1 wherein the at least two orifices comprise notches and the notches intersect the side edges of the plate along the length of the plate and the notches extend into the plate to Jabsen the center axis of the plate relative to the length direction of the plate.

7. The bracket of claim 5 wherein the notches or holes do not intersect the adjacent opposite side edges of the plate along the length of the plate and do not intersect at least one of the at least two openings.

8. The bracket of claim 1 wherein the at least two orifices comprise notches and the notches intersect with at least one of the at least two openings.

9. The bracket of claim 1 wherein the at least two orifices comprise notches and the notches have a length extending parallel to the width direction of the plate.

10. The bracket of claim 1 wherein the at least two orifices are located on opposite sides of at least one of the two openings and midway between opposite ends of the openings.

11. The bracket of claim 1 wherein the at least two orifices comprise at least four orifices and wherein one pair of orifices is located on opposite sides of one of the at least two openings and midway between opposite ends of the one opening and a second pair of orifices is located on opposite sides of a different opening of the at least two openings and midway between a first end of the one opening and a second end of the different opening.

12. A bracket for use with a vent and a vent cover comprising:

a rectangular plate having a front face, a back face, a length and a width where the length is greater than the width, and opposite side edges extending in respective length and width directions with the length direction being longer than the width direction;

at least two openings in the plate with the openings extending between the front and back faces so as to form the openings completely through the plate, each opening wholly contained within the front and back faces so as to not intersect with the side edges and wherein the at least two openings comprise slots and the slots have a length and a width where the length is greater than the width and with the length extending parallel to the length direction of the plate and each slot is located on or along the center axis of the plate relative to the length direction of the plate;

at least one pair of orifices in the plate associated with and on opposite sides of each slot and with the orifices extending between the front and back faces so as to form the orifices completely through the plate, the pair of orifices also located adjacent opposite side edges of the plate along the length of the plate so as to form a weakened zone widthwise and associated with and on opposite sides of each slot for bending the plate along the weakened zone.

13. The bracket of claim 12 wherein the orifices comprise notches and the notches have a length extending parallel to the width direction of the plate and wherein the notches do not intersect the openings.

14. The bracket of claim 12 wherein the at least two orifices are located on opposite sides of at least one of the two openings and midway between opposite ends of the opening.

15. The bracket of claim 12 wherein the at least two orifices comprise at least four orifices and wherein one pair of orifices is located on opposite sides of one of the at least two openings and midway between opposite ends of the one opening and a second pair of orifices is located on opposite sides of a different opening of the at least two openings and midway between a first end of the one opening and a second end of the different opening.

16. The bracket of claim 12 wherein the openings have a longitudinal orientation and the orifices have a longitudinal orientation and wherein the longitudinal orientation of the openings is perpendicular to the longitudinal orientation of the orifices.

17. The bracket of claim 1 in combination with a vent cover and a process for using the bracket, the process comprising:

determining a first opening in the plate for securing the bracket to a vent cover;

determining a second opening in the plate for securing the bracket to a vent; and, forming the bracket in accordance with determining the first opening and determining the second opening.

18. The bracket of claim 17 wherein the process further comprises securing the bracket to the vent cover at the first opening and securing the bracket to the vent at the second opening.

19. The bracket of claim 18 wherein the bracket is secured to the vent at the second opening before the bracket is secured to the vent cover at the first opening.

20. A bracket comprising:

a rectangular plate having a front face, a back face, a length and a width where the length is greater than the width, and opposing side edges extending in respective length and width directions with the length direction being longer than the width direction;

at least two openings in the plate, each opening wholly contained within the front and back faces so as to not intersect with the side edges and wherein the at least two openings consisting of only a single row of slots and the slots have a length and a width where the length is greater than the width and with the length extending parallel to the length direction of the plate and the slots are each located on or along a center axis of the plate relative to the length direction of the plate;

at least one pair of orifices in the plate associated with and on opposite sides of each slot and with the orifices extending between the front and back faces so as to form the orifices completely through the plate, the pair of orifices also located adjacent opposite side edges of the plate along the length of the plate so as to form a weakened zone widthwise and associated with and on opposite sides of each slot for bending the plate along the weakened zone; and, wherein the at least two orifices intersect the side edges of the plate along the length of the plate and the orifices extend into the plate to Jabsen a center axis of the plate relative to the length direction of the plate.

* * * * *